United States Patent [19]

Yang

[11] Patent Number: 4,679,420

[45] Date of Patent: Jul. 14, 1987

[54] FORCE IMMUNE DOOR LATCH

[76] Inventor: Tai-Her Yang, 5-1 Taipin St., Si-Hu Town, Dzan-Hwa, Taiwan

[21] Appl. No.: 688,338

[22] Filed: Jan. 2, 1985

[51] Int. Cl.[4] ..... E05B 13/10

[52] U.S. Cl. ..... 70/422; 70/222; 292/348; 292/353

[58] Field of Search ..... 70/422, 348, 349, 350, 70/351, 352, 353, 221, 222, 224; 292/348, 349, 353; 74/548

[56] References Cited

U.S. PATENT DOCUMENTS

| | | | |
|---|---|---|---|
| 191,363 | 5/1877 | Naylor | 292/353 |
| 485,899 | 11/1892 | Tannenberg | 70/221 |
| 843,052 | 2/1907 | Weber | 292/353 |
| 1,013,878 | 1/1912 | Hilton | 74/548 |
| 1,516,152 | 11/1924 | Dumont | 70/422 |
| 1,611,940 | 12/1926 | Ohmer | 70/422 |
| 1,668,403 | 5/1928 | Haven | 70/221 |
| 2,017,530 | 10/1935 | De Orlow | 70/223 |
| 2,511,522 | 6/1950 | Williams | 70/221 |
| 2,676,050 | 4/1954 | Nichols | 292/348 |
| 2,701,735 | 2/1955 | Segal | 292/348 |
| 2,707,649 | 5/1955 | Young | 292/348 |
| 3,621,685 | 11/1971 | Sargent | 70/422 X |
| 4,195,502 | 4/1980 | Best et al. | 70/422 X |
| 4,312,201 | 1/1982 | Roos | 70/422 |
| 4,370,875 | 2/1983 | Piiroinen | 70/422 |

FOREIGN PATENT DOCUMENTS

| | | | |
|---|---|---|---|
| 254711 | 12/1962 | Australia | 70/221 |
| 1040932 | 10/1958 | Fed. Rep. of Germany | 292/353 |
| 1205737 | 9/1970 | United Kingdom | 292/353 |

*Primary Examiner*—Thomas J. Holko
*Assistant Examiner*—Suzanne L. Dino
*Attorney, Agent, or Firm*—Leonard Bloom

[57] ABSTRACT

An improved force immune door knob/latch is provided which, by use of resiliently-biased ratcheting means, is rendered immune to force resulting from the application of excess torque to the door knob. These resiliently-biased ratcheting means are such that their biasing force is oriented in a direction perpendicular to the longitudinal axis of the door latch shaft.

4 Claims, 9 Drawing Figures

FORCE IMMUNE DOOR LATCH

FIELD OF THE INVENTION

This invention relates to force immune door latches and, in particular, to door knobs positioned on a knob sleeve which, by use of resiliently-biased ratcheting means, are rendered immune to force resulting from the application of excess torque to the door knob.

BACKGROUND OF THE INVENTION

Force immune door knob/latch structures are known in the prior art. As illustrated by U.S. Pat. No. 1,516,152 to Dumont such structures have presented slip clutches wherein clutch projections have been oriented in a direction parallel to the longitudinal axis of the door knob spindle or shaft. In doing so, such structures, as is further illustrated by Dumont, have been positioned within the hand-held portions of the knob.

Other attempts to provide such structures are illustrated by U.S. Pat. No. 4,312,201 to Roos. In Roos '201 a force immune knob is presented which provides protection against excess torque by providing a door knob having a two-piece face plate having a rotative slip fit therebetween.

Finally, other attempts to provide force immune door knobs, as illustrated by U.S. Pat. No. 4,195,502 to Best et al. have relied upon the inclusion of frangible elements which would "break away" in the event that a predetermined level of excessive torque is applied to the knob.

Accordingly, there remains a need to provide a force immune door knob which provides protection against the application of excessive torque by providing resiliently-biased ratcheting means which is positioned between the lock cylinder and the knob sleeve of a door latch wherein the biasing action is oriented in a direction substantially perpendicular to the longitudinal axis of the shaft of the door knob.

SUMMARY OF THE INVENTION

Accordingly, it is an object of the present invention to alleviate the disadvantages and deficiencies of the prior art by providing a force immune door latch having a resiliently-biased ratcheting means, wherein the biasing action is oriented in a direction being substantially perpendicular to the longitudinal axis of the shaft (lock cylinder).

It is another object of the present invention to provide a force immune door latch having a resiliently-biased ratcheting means which is positioned for cooperation between the lock cylinder (shaft) and the knob sleeve of a door latch.

Accordingly, a force immune door latch is provided. This latch has a handle. A cylinder is provided having a locked position and an unlocked position. The cylinder is nested with respect to the handle, such that the cylinder and the handle have a substantially common longitudinal axis. Means cooperating between the cylinder and the handle is provided to preclude substantial axial separation therebetween. A resiliently-biased ratcheting means between the cylinder and the handle is provided. This ratcheting means is provided having its biasing force oriented in a direction substantially perpendicular to the common longitudinal axis to accommodate rotation of the cylinder and the handle, substantially in unison with each other in the unlocked position of the cylinder, but providing relative rotation therebetween in the locked position of the cylinder, whereby in the locked position of the cylinder excessive torque applied to the handle normally sufficient to break the latch will not result in breakage thereof, thereby precluding an undesired destruction of the lock by a burglar or others.

In further accordance with the teachings of the present invention, a force immune door latch is provided. This latch has a handle. A sleeve is provided extending rearwardly from the handle. A cylinder having a locked position and an unlocked position is provided having a plurality of depressions formed annularly therein. The cylinder is nested with respect to the sleeve and the handle such that the handle, sleeve and cylinder have a substantially common longitudinal axis. Means cooperating between the cylinder, sleeve and handle are provided to preclude substantial axis separation therebetween. At least one resiliently biased latch plate is positioned on the sleeve, with its biasing force being oriented inwardly in a direction substantially perpendicular to the common longitudinal axis. Said latch plate has an inwardly directed ratchet point positioned thereon. Thusly, said point is received within the depressions of the cylinder to accommodate rotation of the cylinder and the handle substantially in unison with each other in the unlocked position of the cylinder, but providing relative rotation therebetween in the locked position of the cylinder, whereby in the locked position of the cylinder excessive torque applied to the handle normally sufficient to break the latch will not result in breakage thereof, thereby precluding an undesired destruction of the lock by a burglar or others.

In a preferred embodiment, each of the latch plates is integrally formed from the sleeve by a substantially U-shaped perforation. In another embodiment, each of these integrally formed latch plates is bent in a substantially inward direction.

In another embodiment the means cooperating between the cylinder and the handle to preclude substantial axial separation therebetween is comprised of an annular channel being formed on the cylinder and an inwardly extending tooth being positioned on the sleeve.

In yet further accordance with the teachings of the present invention, a force immune door latch is provided. This latch has a handle. A sleeve is positioned extending rearwardly from the handle. Said sleeve has a plurality of axially oriented grooves formed annularly therein. A cylinder is provided having a locked position and an unlocked position. Said cylinder is nested with respect to the sleeve and the handle, such that the handle, sleeve and cylinder have a substantially common longitudinal axis. Means cooperating between the cylinder, sleeve and handle is provided to preclude substantial axial separation therebetween. At least one resiliently-biased upstanding elongated latch plate is provided. This latch plate is positioned axially oriented on the cylinder with its biasing force being oriented outwardly in a direction substantially perpendicular to the common longitudinal axis. In this manner said latch plate is received within the grooves of the sleeve to accommodate rotation of the cylinder and the handle substantially in unison with each other in the unlocked position of the cylinder, but providing relative rotation therebetween in the locked position of the cylinder, whereby in the locked position of the cylinder excessive torque applied to the handle normally sufficient to break the latch will not result in breakage thereof, thereby precluding an undesired destruction of the lock by a burglar or others.

In another preferred embodiment, each of the latch plates is integrally formed from the cylinder by a substantially U-shaped perforation.

In yet another embodiment, the means cooperating between the cylinder and the handle to preclude substantial aerial separation therebetween is comprised of an annular channel being formed on the cylinder and an inwardly extending tooth being positioned on the sleeve.

In still yet further accordance with the teachings of the present invention, a force immune door latch is provided. This latch has a handle. A sleeve is positioned extending rearwardly of the handle. Said sleeve has a forward reduced end and a rearward enlarged end, said ends defining a shoulder therebetween. An inner annular collar having at least one aperture formed therein. Said collar is positioned abutting the shoulder, and is further nested within the rearward enlarged end of the sleeve on a substantially common longitudinal axis therewith. A cylinder having a locked position and an unlocked position is provided. This cylinder has a plurality of depressions formed annularly therein. Said cylinder is nested with respect to the sleeve, the collar and the handle such that the handle, sleeve, and the collar have a substantially common longitudinal axis. Means cooperating between the collar and the rearward enlarged end are provided to preclude substantial axial separation and rotational movement therebetween. Means cooperating between the cylinder and the forward reduced end of the sleeve are provided to preclude substantial axial separation therebetween. A spring-loaded ball detent is positioned within the aperture of the collar with its biasing force being oriented inwardly in a direction substantially perpendicular to the common longitudinal axis. In this manner said detent is received within the depressions on the cylinder to accommodate rotation of the cylinder and the handle substantially in unison with each other in the unlocked position of the cylinder, but providing relative rotation therebetween in the locked position of the cylinder, whereby in the locked position of the cylinder excessive torque applied to the handle normally sufficient to break the latch will not result in breakage thereof, thereby precluding an undesired destruction of the lock by a burglar or others.

In yet another preferred embodiment, the means cooperating between the cylinder and the forward end of the sleeve to preclude axial separation therebetween is comprised of an annular channel being formed on the cylinder and an inwardly extending tooth being positioned on the sleeve.

In still yet another embodiment, the means cooperating between the collar and the rearward enlarged end to preclude substantial axial separation and rotational movement therebetween is comprised of an annular slot being formed in the collar and an inwardly extending tooth being positioned on the sleeve.

In still another preferred embodiment, the force immune door latch, is further comprised of the collar having a plurality of apertures formed therein, said apertures being spaced annularly about said collar and a plurality of spring-loaded ball detents, each of said ball detents being positioned in respective aperture of the collar wherein its biasing force of each of said spring-loaded ball detents is oriented inwardly in a direction substantially perpendicular to the common longitudinal axis.

These and other objects of the present invention will become apparent from a reading of the following detailed description taken in conjunction with the accompanying drawings.

BRIEF DESCRIPTION OF THE DRAWINGS

FIG. 1-1 is a side view, partially in section, of the force immune door latch of FIG. 1 as it is assembled with part of its outer cover broken away.

FIG. 1-2 is a cross-sectional view of the force immune door latch of FIG. 1, the section being taken along section line 1-2—1-2 of FIG. 1-1.

FIG. 2 is an exploded view, in perspective, of another force immune door latch made in accordance with the present invention.

FIG. 2-1 is a side view, partially in section, of the force immune door latch of FIG. 2 as it is assembled with part of its outer cover broken away.

FIG. 2-2 is a cross-sectional view of the force immune door latch of FIG. 2, the section being taken along section line 2-2—2-2 of FIG. 2-1.

FIG. 3-1 is a side view, partially in section, of the force immune door latch of FIG. 3 as it is assembled with part of its outer cover broken away.

FIG. 3-2 is a cross-sectional view of the force immune door latch of FIG. 3, the section being taken along section line 3-2—3-2 of FIG. 3-1.

DESCRIPTION OF THE PREFERRED EMBODIMENTS

Figure 1:
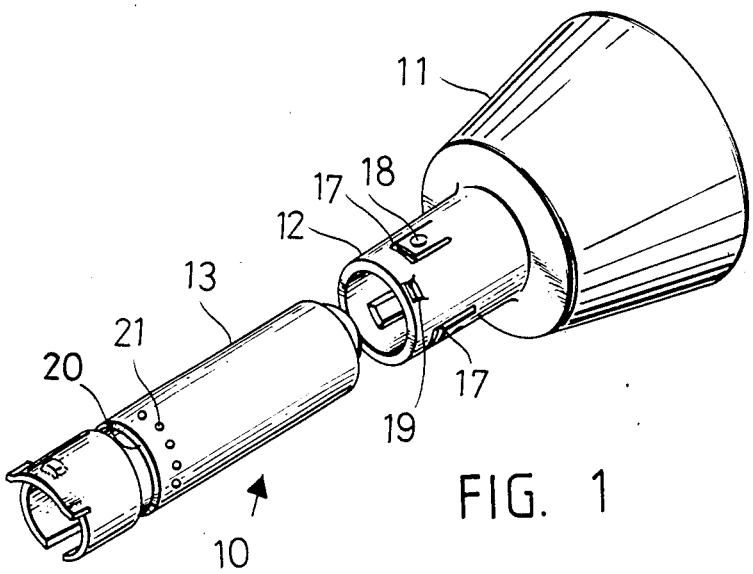
FIG. 1 is an exploded view, in perspective of a force immune door latch made in accordance with the present invention.
Figure 1:
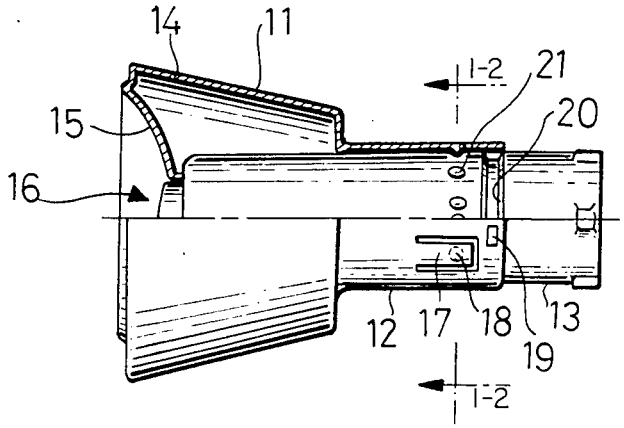

Referring now to the drawings, as shown in FIG. 1, there is a preferred embodiment of the force immune door latch 10 of the present invention. This latch is comprised of a door handle having a hand-held door knob portion (handle) 11 and a sleeve portion (inner ring) 12, being integrally formed with knob 11 and extending in an axial direction from the rearward portion of knob 11. This latch is further comprised of an elongated door latch shaft or locking cylinder (cylinder type locks heart) 13 which is adapted to be telescopically received in the sleeve portion 12 with a relatively snug fit therebetween.

Figures 1, 2:
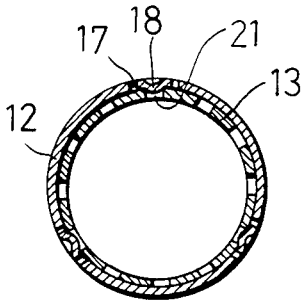
Figure 2:
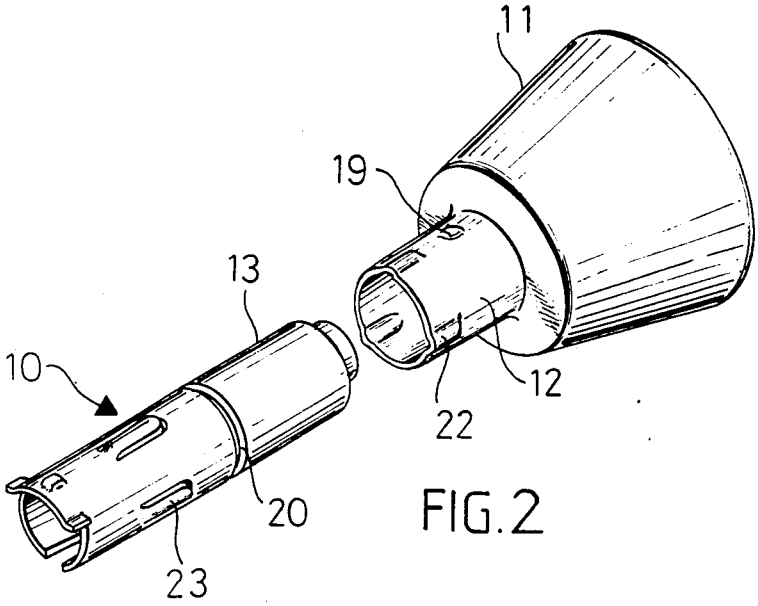
Figures 1, 2:
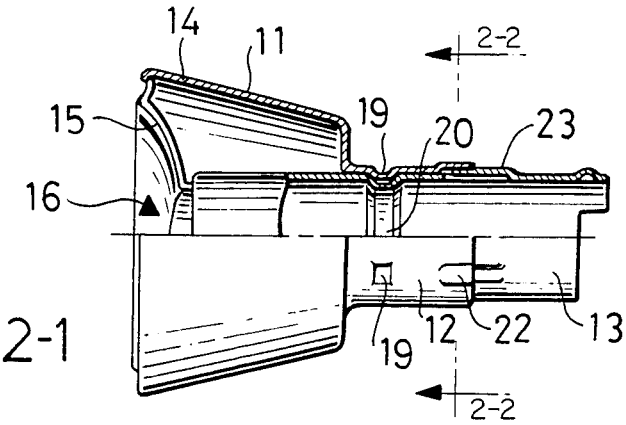
Figure 2:
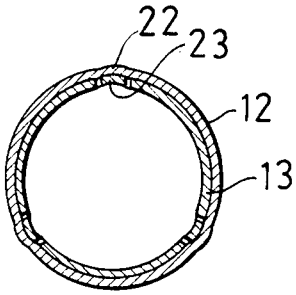

With further reference now to FIGS. 1-1 and 1-2, in addition to FIG. 1, knob 11 is in the form of a hollow casing 14, having a front face 15. Front face 15 is formed with a lock aperture 16 centrally positioned therein.

Sleeve 12 is provided with at least one resiliently biased detent latch plate (elasticity plate) 17 formed therein. Preferably, as seen in FIG. 1-1, four such plates are provided, said plates being spaced annularly about sleeve 12. Latch plates 17 are integrally formed from sleeve 12 by having a substantially U-shaped perforation formed in said sleeve 12. If desired said plates may be slightly bent inwardly in a direction toward the shaft 13. Each of said detent latch plates 17 is also provided with an inwardly projecting point or detent 18 such as is seen in FIG. 1-2. Formed thusly, each of said plates 17 is resiliently biased against outward movement of either detents 18 or plates 17.

Located rearwardly of latch plates 17, sleeve 12 also carries at least one inwardly extending tooth (or indented structure) 19. Preferably, a plurality of such teeth are provided, said teeth 19 being positioned annularly about sleeve 12 and integrally formed therewith. These teeth 19 prevent undesirable axial movement of the shaft 13 along its longitudinal axis within sleeve 12, in a manner that shall be discussed later.

Shaft 13 is formed having an indented annular channel (ring shaped indented structure) 20 being positioned in substantially the rearward portion thereof. Positioned thusly, said indented channel 20 receives teeth 19 therein when the shaft 13 is inserted into the sleeve 12 as seen in FIGS. 1-1 and 1-2. In this fashion, teeth 19 are engaged by channel 20 and are retained therein, thereby preventing further axial movement of the shaft 13 within sleeve 12.

If desired, shaft 13 may be provided with a locking mechanism at its forward end.

Finally, door latch shaft 13 is further formed with at least one hole or depression 21 for receiving inwardly projecting point 18 therein. In the embodiment illustrated in FIGS. 1, 1-1 and 1-2, a plurality of such holes or depressions 21 are provided. Said depressions 21 are positioned annularly about shaft 13 in a position thereon forwardly of indented channel 20.

In this configuration, insertion of shaft 13 into sleeve 12 causes the walls of said shaft 13 to slidably engage tooth 19 and detent 18. Engagement of the detent 18 forces latch plate 17 outwardly resulting in detent 18 being constantly urged in a direction perpendicular to the longitudinal axis of the shaft 13. Continued insertion of shaft 13 towards front face 15 into a position wherein the forward end of shaft 13 abuts aperture 16, results in the annular channel 20 engaging tooth 19 at substantially the same time as detent 18 engages depression 21. Engagement of tooth 19 in channel 20 "locks" shaft 13 into sleeve 12 thereby preventing further axial movement of the shaft 13. Engagement (seating) of detent 18 in depression 21 37 locks" knob 11 and sleeve 12 to the shaft 13 for rotational movement therewith when torque is applied to knob 11. When excess torque is applied to knob 11, the torque overcomes the biasing force of detent latches 17 disengaging (unseating) detent 18 from depression 21, thereby permitting free rotation between the knob 11 having sleeve 12 and the shaft 13.

With reference now to FIGS. 2, 2-1 and 2-2, there is illustrated another embodiment of the force immune door latch 10 of the present invention. In this embodiment, the latch 10 is comprised of a substantially hollow hand-held door knob 11 having a front face 15, a door latch shaft 13 and a sleeve portion 12 integrally formed with knob 11 and extending in an axial direction from the rearward portion of knob 11. Knob 11 is identical in structure, shape and appearance as that knob 11 which was previously disclosed and described above with reference to FIGS. 1, 1-1 and 1-2.

In this embodiment, sleeve 12 is provided with snap detent grooves 22. Said detent grooves 22 are outwardly formed and are annularly spaced about sleeve 12. Located forwardly of grooves 22, sleeve 12 is also provided with a plurality of inwardly extending teeth 19 (only one of which can be seen in FIG. 2). Said teeth 19 are positioned annularly about sleeve 12 and are integrally formed therewith. These teeth prevent undesirable axial movement of the shaft 13 along its longitudinal axis within sleeve 12, as shall be discussed.

If desired, shaft 13 may carry a lock mechanism in its forward end.

Shaft 13 is an elongated shaft formed having an indented annular channel 20 being positioned in substantially the forward portion thereof. Positioned thusly, said indented channel 20 receives teeth 19 therein, when the shaft 13 is inserted into the sleeve 12 as seen in FIGS. 2-1 and 2-2. In this fashion, teeth 19 are engaged by channel 20 and are therein, thereby preventing further axial movement of the shaft 13 within the sleeve 12.

Finally, door latch shaft 13 is further formed with a plurality of resiliently-biased detent latch plates 23. Plates 23 are annularly spaced about shaft 13, rearwardly of channel 20. Plates 23 are integrally formed from shaft 13 by a substantially U-shaped perforations. Formed thusly, each of said plates 23 is resiliently biased against inward movement. Said plates 23 are further formed so as to substantially correspond to the size and shape of, and to be received in, detent grooves 22.

In this configuration, insertion of shaft 13 into sleeve 12 causes the walls of shaft 13 to slidably engage tooth 19. Continued insertion of shaft 13 towards front face 15, into a position wherein the forward end of shaft 13 abuts aperture 16, results in annular channel 20 engaging tooth 19 at substantially the same time as latch plates 23 engage grooves 22. Engagement of tooth 19 in channel 20 "locks" shaft 13 into sleeve 12, thereby preventing further axial movement of the shaft 13. Engagement (seating) of plates 23 in grooves 22 "locks" knob 11 and sleeve 12 to the shaft for rotational movement therewith when torque is applied to knob 11. When excess torque is applied to the knob 11, the torque on the handle overcomes the biasing force of the latch plates 23, thereby disengaging (unseating) resilient latches 23 and permitting free rotation between knob 11 having sleeve 13 and the shaft 13.

Figure 3:
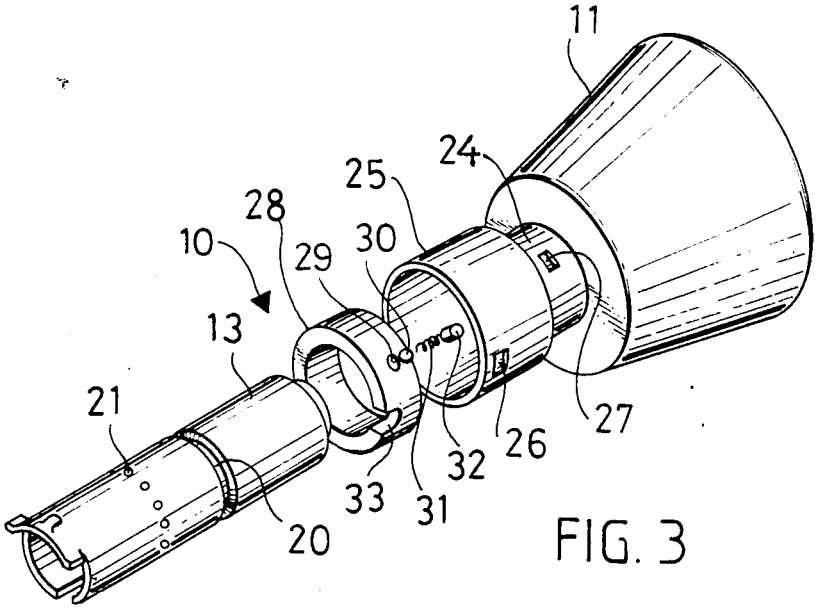
FIG. 3 is an exploded view, in perspective, of still another force immune door latch made in accordance with the present invention.
Figures 1, 3:
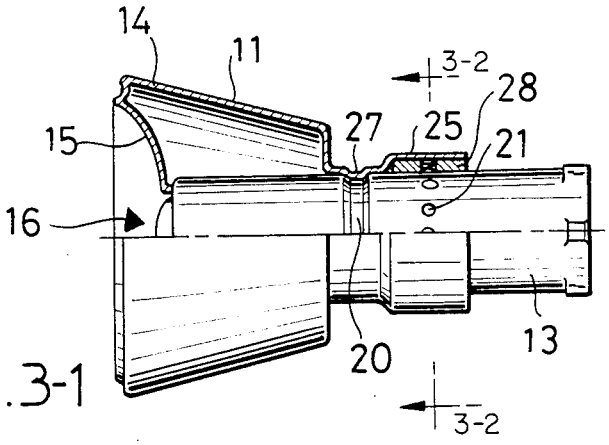
Figures 2, 3:
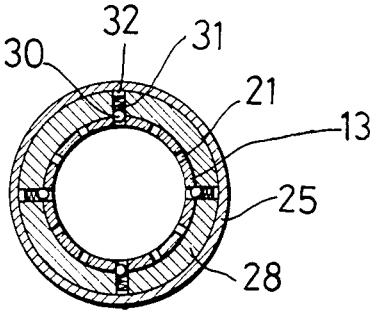

Finally, with reference to FIGS. 3, 3-1 and 3-2 there is illustrated still another embodiment of the force immune door latch 10 of the present invention. In this embodiment, the latch 10 is comprised of a substantially hollow hand-held door knob 11 having a front face 15, a door latch shaft 13 and a sleeve portion 12, integrally formed with knob 11 and extending in an axial direction from the rearward portion of knob 11. Knob 11 is identical in structure, shape and appearance as that knob 11 which was previously disclosed and described above with reference to FIGS. 1, 1-1 and 1-2.

In this embodiment, the sleeve 12 has a reduced forward end 24 and an enlarged rearward end 25, said rearward end being of greater diameter than the forward end 24. An annular shoulder is defined between forward end 24 and rearward end 25. Finally, sleeve 12 also carries a pair of integrally formed inwardly extending teeth (or indented structures) 26 and 27. Said teeth 26 and 27 are positioned on the rearward and the forward portions of the sleeve, respectively.

A ratchet collar 28 is provided being annular in shape. This collar 28 is of substantially identical diameter and dimensions as the forward end 25 of sleeve 12, as seen in FIGS. 3, 3-1 and 3-2. Collar 28 is formed with an annular cutout or locking slot 33. Collar 28 also has at least one aperture 29 formed therein. It is to be understood that, consonant with the teachings of the present invention, a plurality of apertures 29 can be provided. Positioned within each aperture is a conventional spring-loaded detent ball mechanism comprised of a steel ball 30, a spring 31 and a block 32.

The collar 28 is positioned within the rearward end 25 of the sleeve 12 so that said collar 28 forward abuts the annular shoulder, thereby preventing further forward movement of the collar 28. Locking slot 33 is aligned to receive rearward, tooth 26 therein, whereby further rearward and rotational movement of the collar 28 is prevented.

Door latch shaft 13 is an elongated shaft which, if desired, may carry a lock mechanism in its forward end. Shaft 13 is formed having an indented annular channel 20 being positioned in substantially the forward portion thereof. Positioned thusly, said indented channel 20 receives forward tooth 27 therein when the shaft 13 is inserted into the collar 28 and the sleeve 12, as seen in FIGS. 3-1 and 3-2. In this fashion, tooth 27 is engaged by channel 20 and is retained therein, thereby preventing further axial movement of the shaft 13 within the sleeve 12.

Finally, door latch shaft 13 is further formed with a plurality of holes or depressions 21 for receiving the ball 30 of the spring loaded detent ball mechanism therein. In the embodiment illustrated in FIGS. 3, 3-1 and 3-2, a plurality of such holes or depressions 21 are provided being positioned annularly about shaft 13 in a position thereon being rearwardly of the indented channel 20.

Obviously, many modifications may be made without departing from the basic spirit of the present invention. Accordingly, it will be appreciated by those skilled in the art, that within the scope of the appended claims, the invention may be practiced other than has been specifically described herein.

What is claimed is:

1. A force immune door latch, in combination, comprising: a handle, a sleeve extending rearwardly of the handle, said sleeve having a forward reduced end and a rearward enlarged end, said ends defining a shoulder therebetween, an inner annular collar having at least one aperture formed therein, said collar being positioned abutting the shoulder, nested within the rearward enlarged end of the sleeve on a substantially common longitudinal axis therewith, a cylinder having a locked position and an unlocked position and further having a plurality of depressions formed annularly therein, said cylinder being nested with respect to the sleeve, the collar and the handle such that the handle, sleeve, and the collar having a substantially common longitudinal axis, means cooperating between the collar and the rearward enlarged end to preclude substantial axial separation and rotational movement therebetween, means cooperating between the cylinder and the forward reduced end of the sleeve to preclude substantial axial separation therebetween, a spring-loaded ball detent being positioned within the aperture of the collar with its biasing force being oriented inwardly in a direction substantially perpendicular to the common longitudinal axis, wherein said detent is received within the depressions on the cylinder to accommodate rotation of the cylinder and the handle substantially in unison with each other in the unlocked position of the cylinder, but providing relative rotation therebetween in the locked position of the cylinder, whereby in the locked position of the cylinder excessive torque applied to the handle normally sufficient to break the latch will not result in breakage thereof, thereby precluding an undesired destruction of the lock by a burglar or others.

2. The force immune door latch of claim 1, wherein the means cooperating between the cylinder and the forward end of the sleeve to preclude axial separation therebetween is comprised of an annular channel being formed on the cylinder and an inwardly extending tooth being positioned on the sleeve.

3. The force immune door latch of claim 1, wherein the means cooperating between the collar and the rearward enlarged end to preclude substantial axial separation and rotational movement therebetween is comprised of an annular slot being formed in the collar and an inwardly extending tooth being positioned on the sleeve.

4. The force immune door latch of claim 1, being further comprised of the collar having a plurality of apertures formed therein, said apertures being spaced annularly about said collar and a plurality of spring-loaded ball detents, each of said ball detents being positioned in a respective aperture of the collar wherein its biasing force of each of said spring-loaded ball detents is oriented inwardly in a direction substantially perpendicular to the common longitudinal axis.

* * * * *